US011623465B2

(12) United States Patent
Scherer et al.

(10) Patent No.: US 11,623,465 B2
(45) Date of Patent: *Apr. 11, 2023

(54) OPTICALLY VARIABLE SECURITY ELEMENT HAVING REFLECTIVE SURFACE REGION

(71) Applicant: GIESECKE+DEVRIENT CURRENCY TECHNOLOGY GMBH, Munich (DE)

(72) Inventors: Kai Hermann Scherer, Munich (DE); Maik Rudolf Johann Scherer, Grainau (DE); Raphael Dehmel, Neubeuern (DE); Michael Rahm, Bad Tolz (DE); Giselher Dorff, Holzkirchen (DE); Andreas Rauch, Ohlstadt (DE); Christian Fuhse, Otterfing (DE); Tobias Sattler, Holzkirchen (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/258,666

(22) PCT Filed: Jul. 9, 2019

(86) PCT No.: PCT/EP2019/000208

§ 371 (c)(1),
(2) Date: Jan. 7, 2021

(87) PCT Pub. No.: WO2020/011390

PCT Pub. Date: Jan. 16, 2020

(65) Prior Publication Data

US 2021/0268825 A1 Sep. 2, 2021

(30) Foreign Application Priority Data

Jul. 9, 2018 (DE) ..... 10 2018 005 447.1

(51) Int. Cl.
*B42D 25/324* (2014.01)
*B42D 25/351* (2014.01)

(52) U.S. Cl.
CPC ..... *B42D 25/324* (2014.10); *B42D 25/351* (2014.10)

(58) Field of Classification Search
CPC ..... B42D 25/324; B42D 25/351; B42D 2035/14; B42D 25/36; B42D 25/373;
(Continued)

(56) References Cited

U.S. PATENT DOCUMENTS 4,568,141 A 2/1986 Antes
5,128,779 A * 7/1992 Mallik ..... G03H 1/0256 359/2

(Continued)

FOREIGN PATENT DOCUMENTS

DE 39636991 T2 12/2007
DE 102007034716 A1 1/2009

(Continued)

OTHER PUBLICATIONS

Machine Translation of WO 2016/020066 via EPO (Year: 2016).*

(Continued)

*Primary Examiner* — Laura C Powers
*Assistant Examiner* — Rebecca L Grusby
(74) *Attorney, Agent, or Firm* — Workman Nydegger

(57) ABSTRACT

An optically variable security element wherein the areal expansion whereof defines a z direction standing perpendicularly thereon, and has a multicolored, reflective areal region. The areal region includes two relief structures arranged at different height levels in the z direction. The relief structures are each supplied with an ink coating which produce a different color impression. The ink coating of the relief structure disposed at a higher level is configured in the (Continued)

feature region as a regular or irregular grid with grid elements and grid spaces. The dimensions of the grid elements and/or grid spaces are below 140 μm at least in one direction, so that, in the feature region, for a viewer from at least one viewing angle, the ink coating of the relief structure disposed at a lower level is visible through the grid spaces of the ink coating of the relief structure disposed at a higher level.

20 Claims, 4 Drawing Sheets

(58) Field of Classification Search
CPC .... B42D 25/378; B42D 25/435; B42D 25/44; B42D 25/445; G02B 5/1823
See application file for complete search history.

(56) References Cited

U.S. PATENT DOCUMENTS

| | | | | |
|---|---|---|---|---|
| 6,060,143 | A | 5/2000 | Tompkin et al. | |
| 8,603,615 | B2 | 12/2013 | Keller | |
| 8,613,471 | B2 | 12/2013 | Heim | |
| 2005/0104364 | A1* | 5/2005 | Keller | B42D 25/382 283/72 |
| 2005/0170259 | A1* | 8/2005 | Holmes | B42D 25/324 430/1 |
| 2010/0045024 | A1 | 2/2010 | Attner et al. | |
| 2010/0196587 | A1 | 8/2010 | Keller | |
| 2011/0007374 | A1* | 1/2011 | Heim | B42D 25/324 359/884 |
| 2011/0079997 | A1 | 4/2011 | Heim | |
| 2011/0101670 | A1* | 5/2011 | Heim | B42D 25/351 204/192.1 |
| 2013/0069360 | A1* | 3/2013 | Power | G02B 3/0056 283/85 |
| 2017/0028762 | A1* | 2/2017 | Ide | B42D 25/40 |
| 2021/0031553 | A1* | 2/2021 | Brehm | B42D 25/36 |

FOREIGN PATENT DOCUMENTS

| | | | | |
|---|---|---|---|---|
| DE | 102007061827 | A1 | 6/2009 | |
| EP | 0105099 | A1 | 4/1984 | |
| EP | 3184318 | A1 * | 6/2017 | |
| WO | 9719820 | A1 | 6/1997 | |
| WO | WO-2016020066 | A2 * | 2/2016 | B42D 25/425 |
| WO | WO-2017028954 | A1 * | 2/2017 | B42D 25/29 |

OTHER PUBLICATIONS

Machine translation of EP 3,184,318 via EPO (Year: 2017).*
Machine translation of WO 2017/028954 via EPO (Year: 2017).*
Search Report from corresponding German Application No. DE 102018005447.1, dated Mar. 15, 2019.
International Search Report and Written Opinion from PCT Application No. PCT/EP2019/000208, dated Aug. 30, 2019.

* cited by examiner

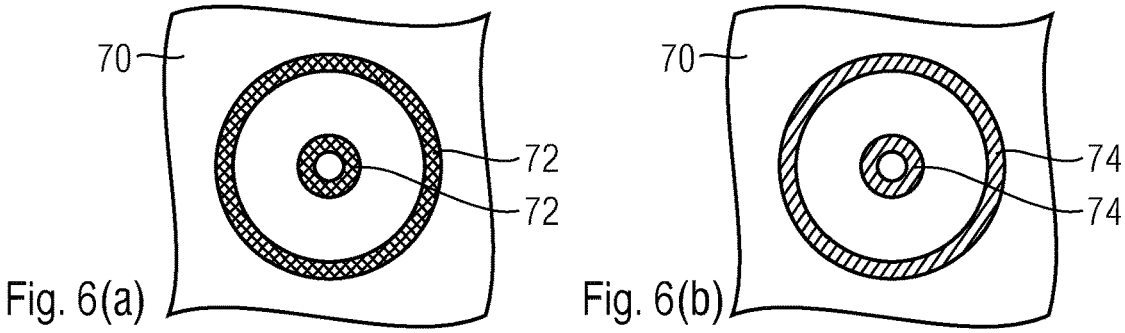
Fig. 6(a) Fig. 6(b)
Fig. 6
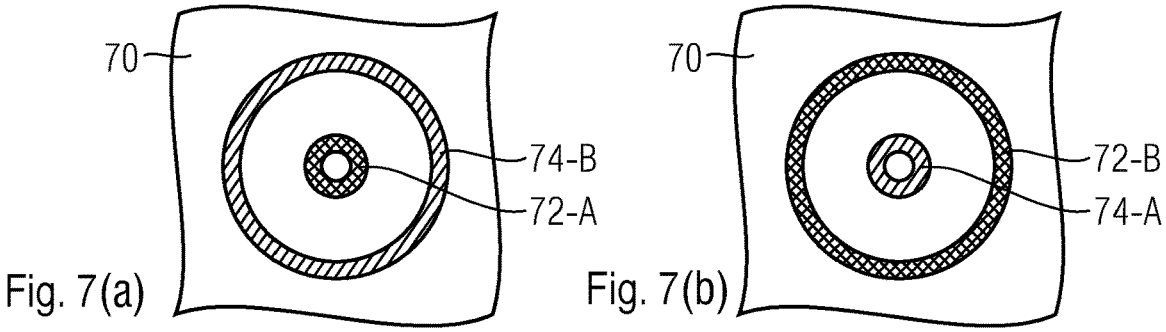
Fig. 7(a) Fig. 7(b)
Fig. 7
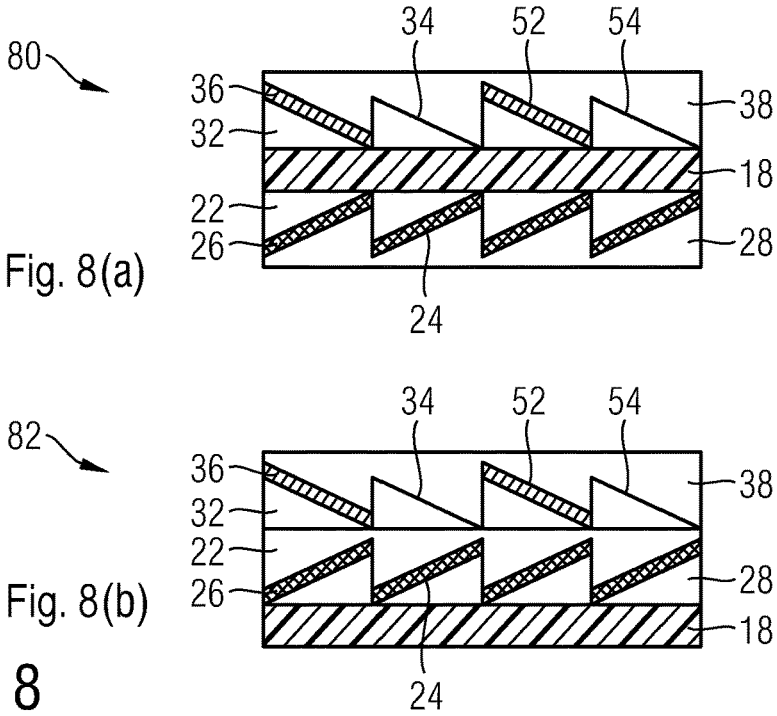
Fig. 8(a)
Fig. 8(b)
Fig. 8

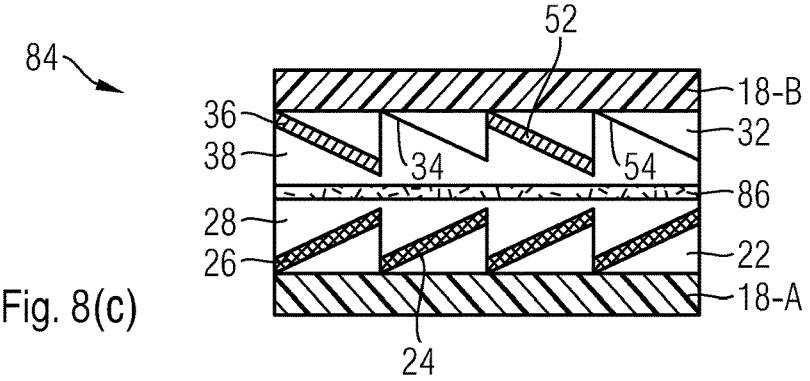
Fig. 8(c)
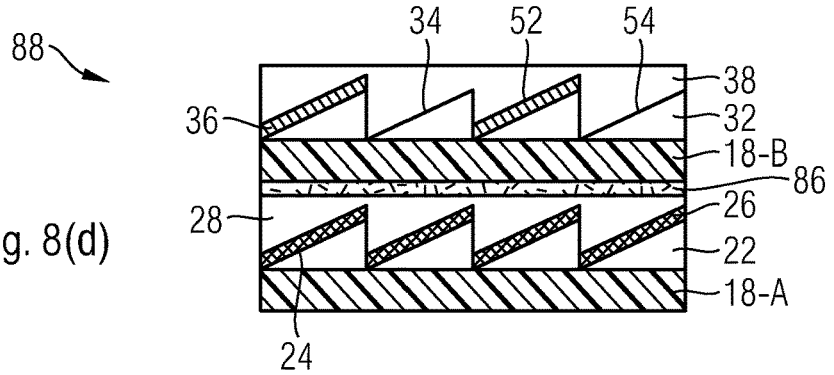
Fig. 8(d)
Fig. 8
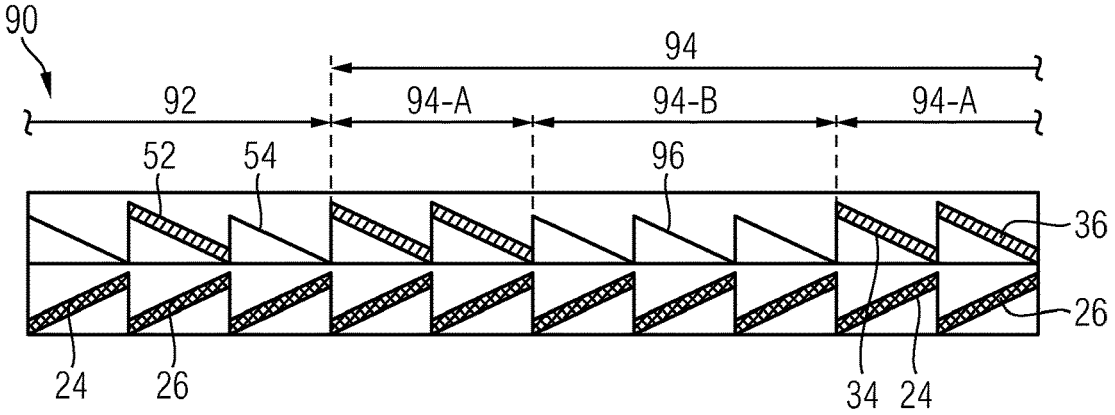
Fig. 9
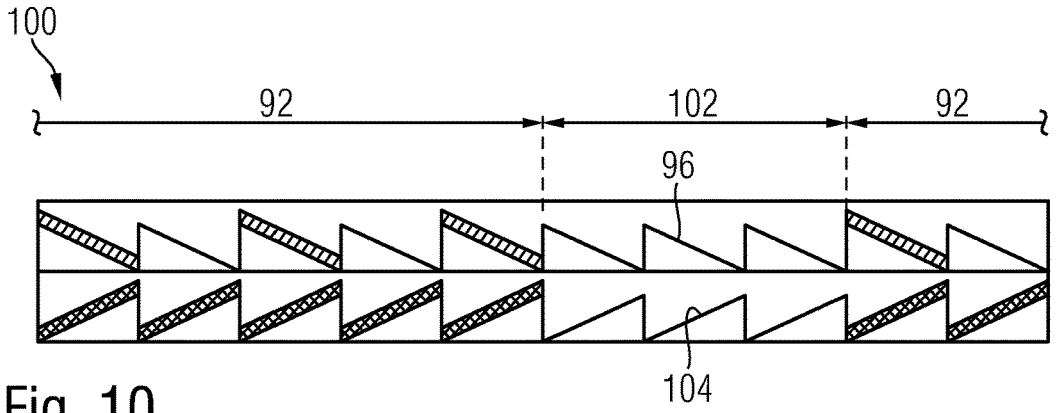
Fig. 10

OPTICALLY VARIABLE SECURITY ELEMENT HAVING REFLECTIVE SURFACE REGION

BACKGROUND

The invention relates to an optically variable security element for securing value objects with an areal carrier and a reflective areal region arranged on the carrier. The invention also relates to a method for manufacturing such a security element and a data carrier equipped with such a security element.

Data carriers, such as value documents or identity documents, but also other value objects, such as branded articles for instance, are often supplied for securing purposes with security elements which permit a verification of the authenticity of the data carrier and which at the same time serve as protection from unauthorized reproduction. The security elements can be configured, for example, in the form of a security thread embedded in a banknote, a cover foil for a banknote with a hole, an applied security strip, a self-supporting transfer element or also in the form of a feature region printed directly onto a value document.

A special role in authentication assurance is played by security elements with viewing angle-dependent effects, because these cannot be reproduced even with the most modern copying devices. The security elements are equipped for this purpose with optically variable elements which convey a different image impression to the viewer from different viewing angles, showing, for example, a different color impression or brightness impression and/or a different graphic motif depending on the viewing angle. In the prior art, for example, movement effects, pumping effects, depth effects or flip effects are described as optically variable effects, which are implemented with the aid of holograms, microlenses or micromirrors.

It is known to produce a simple colored area with the aid of a diffractive structure, but the color produced by the diffractive structure depends on the viewing angle. A grid of opaque elements, which is arranged at a suitable distance above the diffractive structure, can be employed to reduce the viewing-angle dependence of the color.

SUMMARY

Proceeding from this, it is the object of the invention to further increase the security against forgery and the visual attractiveness of generic optically variable security elements and, in particular, to make available optically variable security elements with two or more different appearances and/or effects in different colors.

The optically variable security element comprises a multicolored, reflective areal region. The areal expansion of the security element defines a z direction that stands perpendicularly on the area. The multicolored, reflective areal region includes two relief structures which are arranged in the z direction at different height levels. The relief structures are each supplied with an ink coating that produces a different color impression. The two relief structures also overlap in a feature region.

In the present case, the ink coating of the relief structure disposed at a higher level is configured in the feature region as a regular or irregular grid with grid elements and grid spaces. The dimensions of the grid elements and/or the grid spaces are at least in one direction below 140 μm. In the feature region, the ink coating of the relief structure disposed at a lower level appears to a viewer from at least one viewing angle through the grid spaces of the ink coating of the relief structure disposed at a higher level.

In an advantageous embodiment, the grid elements and grid spaces of the grid have the same shape and preferably also the same size. The grid elements and/or the grid spaces can be formed by strip-shaped, square, triangular or other polygonal elements, but can also have irregular shapes. The grid itself can be regular, i.e. have a regular arrangement of grid elements and grid spaces, but can also be an irregular grid, for example a stochastic grid, in which the grid elements and/or grid spaces have irregular spacings and/or sizes and/or shapes.

The area coverage of the grid by the grid elements is advantageously between 30% and 70%, preferably between 40% and 60%, in particular approximately 50%. The area coverage of the grid and the brightness of the ink coatings are advantageously matched to one another in order to achieve substantially the same brightness of the ink coating of the relief structure disposed at a higher level and the ink coating of the relief structure disposed at a lower level that appears through the grid spaces. By the choice of area coverage, however, differently bright color impressions of the two ink coatings can also be produced in a targeted manner.

The grid elements and/or grid spaces can each represent separate elements or also form a coherent structure. The dimensions of both the grid elements and the grid spaces are preferably below 140 μm at least in one direction. In particular, the dimensions of the grid elements and/or the grid spaces are preferably between 20 μm and 140 μm in one or both lateral directions, preferably between 40 μm and 120 μm, in particular between 60 μm and 100 μm.

The relief structures are preferably embossed structures. In particular, embossing in a curable layer, such as only for example UV lacquers, is further preferred. Alternative generation methods, such as, for example, subtractive lasering or additive construction, for example using 3D printing, are conceivable but less cost-effective.

The relief structures of the polychromatically reflective areal region preferably form monochromatically reflective relief structures together with the ink coating in the feature region. The polychromatically reflective areal region is preferably a dichromatically reflective areal region. The security element can comprise several differently dichromatic, reflective areal regions. The additional reflective areal region (or regions) can in particular be adjoining, surrounding or spaced apart from the polychromatically reflective areal region described above. In further embodiments, the security element can include an additional, differently dichromatic, feature region or several additional, respectively differently dichromatic, feature regions. The additional feature region (or the additional feature regions) can in particular be adjoining, surrounding or spaced apart from the feature region described above.

The ink coating of the relief structure disposed at a higher level and/or disposed at a lower level appears in the present case, in particular, only depending on the viewing angle. When viewed in the z direction, the ink coating of the relief structure disposed at a higher level and/or disposed at a lower level does not appear. The ink coating of the relief structure disposed at a lower level (and of that disposed at a higher level) appears reflective in color at the viewing angle. At the viewing angle, the light is reflected from this relief structure to the viewer and thus appears in the present sense, wherein the ink coating determines the color impression. Since the impinging light also has a preferred direction—in particular substantially perpendicular—a clearly perceptible colored light reflex is created for the observer, as is known.

Alternatively, the relief structure disposed at a higher level and its ink coating could be referred to as the first (or upper) relief structure and the first (or upper) ink coating, and the relief structure disposed at a lower level and its ink coating could be referred to as the second (or lower) relief structure and second (or lower) ink coating.

In embodiments it is provided that in a part of the feature region (or the entire feature region), depending on the viewing angle, either the ink coating of the relief structure disposed at a higher level or the ink coating of the relief structure disposed at a lower level appears to the viewer. Thus, either the first color impression of the first (or upper) ink coating or the second color impression of the second (or lower) ink coating is created in the part of the feature region—only alternatively, but not at the same time. A first viewing angle range in which the ink coating disposed at a lower level appears, and a second viewing angle range in which the ink coating disposed at a higher level appears, do not overlap, preferably adjoin one another. In an optional third viewing angle range, neither of the two ink coatings appears to the viewer. The size of the third viewing angle range is advantageously greater than the sum of the sizes of the first and second viewing angle ranges.

In a further part of the feature region, both ink coatings can be visible at the same time to the viewer from at least one viewing angle, in particular can appear at the same time at one viewing angle or can be visible regardless of the viewing angle. The viewer sees the remaining part in a mixed color tone.

Further, the feature region is preferably configured such that at the viewing angle the (second) ink coating of the relief structure disposed at a lower level appears in a first part of the feature region and the ink coating of the relief structure disposed at a higher level (or neither of the two ink coatings) appears in a second part of the feature region. In an optional third part of the feature region, accordingly neither of the two ink coatings (or the ink coating of the relief structure disposed at a higher level) will appear.

The two relief structures can, depending on the viewing angle, make available the color change for an unchanged motif or make available the color change together with a motif change. The motifs of the two relief structures can vary in particular with regard to shape (for example head, apple or figure), movement (statically to moved or moved to moved—with linear, rotating and/or pumping movement) and/or three-dimensionality (two-dimensionally to three-dimensional or differently three-dimensional—with a positively or negatively curved appearance and/or floating in front of and/or behind a plane). It is known per se to produce such motifs and also specific motif changes with the aid of relief structures.

In an advantageous embodiment, it is provided that the relief structure disposed at a higher level produces a first motif with a first color impression, which is visible from a first viewing angle range, and the relief structure disposed at a lower level produces a second motif with a second, different color impression, which is visible from a second viewing angle range, wherein the first and the second viewing angle range do not overlap. When tilted, the security element then shows a binary change in color and effect without an overlap region. The two viewing angle ranges preferably adjoin one another or are separated only by an angular distance of a few degrees, so that the associated image impressions switch as seamlessly as possible for the viewer. The first and second motif can also be identical, so that only a binary color change of the motif results when tilted.

In another, likewise advantageous embodiment, it is provided that the relief structure disposed at a higher level produces a first movement motif with a first color impression and the relief structure disposed at a lower level produces a second movement motif with a second, different color impression, wherein, when tilting the security element, the first and second movement motif move in a manner offset to one another or in a manner against one another and, in an overlap position in which both movement motifs are visible, cross each other and/or move consecutively through the same part of the feature region.

In a movement motif, a part of the motif moves when tilted, for example a bright bar moves across the motif area. The motif part can move linearly or along a curved path and can also change its shape and size during the movement, for example in so-called pumping or morphing effects.

More concretely, the following variants have turned out to be particularly optically attractive:

- A binary motif flip between curved and/or three-dimensionally appearing image motifs with a binary color change. A first viewing angle range extends, for example, from +5° to +20° with reference to a surface normal of the security element, a second viewing angle range from −5° to −20°. The first and second motifs can also be identical, thus resulting in a purely binary color change.
- Pumping or running effects with different colors that cross each other locally, for example running in opposite directions. A viewing angle range for the first movement motif extends, for example, from −20° to +20°; a viewing angle range for the second, opposite movement motif, conversely, extends from +20° to −20°. In the case of movement motifs running in offset manner, one motif runs, for example, from −20° to +10°, the other from −10° to +20°.
- A binary motif flip in which the curved and/or three-dimensionally appearing differently colored motifs are disposed one inside the other and/or overlap each other. When tilted, in particular a simultaneous color change of the inner and outer motifs or the overlapping motif parts takes place. The viewing angle ranges may or may not include the z direction. The viewing angles (of the regions) can also be positive and negative, only positive or only negative.

In an advantageous variant of the invention, the reflective areal region includes exactly two relief structures, which are each arranged at a specific height level.

The relief structures of the reflective areal region are advantageously each characterized by a maximum pitch, wherein the distance between adjacent height levels in the z direction is greater than the maximum pitch of the embossed structure region respectively disposed at a lower level. The distance is preferably greater than 150%, particularly preferably 200%, of the maximum pitch. Further preferably, the distance between adjacent height levels in the z direction is between 150% and 750%, particularly preferably between 200% and 500%, further preferably between 200% and 400% of the maximum pitch of the embossed structure region disposed at a lower level.

The relief structures are preferably micromirror arrangements, in particular micromirror arrangements with directional micromirrors. The micromirror arrangement(s) is (are) achromatic micromirror arrangement(s), which in particular is (are) non-diffractive. The directional mirrors of the micromirror arrangement are distinguished by a preferred reflection direction which can be set, for example, by means of an inclination angle and/or azimuth angle. The individual directional micromirrors of the micromirror arrangement reflect either the light to the viewer or not (bright or dark), depending on their orientation for the viewing angle. Only through the ink coating does the micromirror appear chromatically reflective or not (chromatically bright or dark). Areas oriented in parallel or perpendicularly to the polychromatically reflective areal region are not directional mirrors in the present sense. The directional micromirrors can be regularly or irregularly configured (e.g. same shape or varying shape) and/or arranged (e.g. in a pattern or distributed quasi-randomly). Flat mirrors are particularly suitable as directional mirrors. Alternatively, directional concave mirrors and/or directional Fresnel-like (i.e. substructured) mirrors can be employed. In one aspect, each grid element may correspond to exactly one directional micromirror or several directional nanomirrors or micromirrors.

If the relief structures are formed, for example, by micromirror arrangements, the pitch of the micromirrors depends on their lateral dimensions and their angles of inclination. Even with the same lateral dimensions, the angles of inclination of the micromirrors are typically different, so that the micromirrors have different pitches. However, the maximum pitch of its micromirrors is characteristic of the micromirror arrangement. The above-mentioned maximum pitches ("pitch less than") are preferred. For example, if the micromirrors have an edge length of 10 μm and a maximum angle of inclination of 30°, then the maximum pitch of the micromirror arrangement is given by $$G_{max}=10\ \mu m*\tan(30°)=5.8\ \mu m,$$

wherein the individual micromirrors can have a pitch between 0 and $G_{max}$ depending on the angle of inclination. The distance of the micromirror arrangement to the micromirror arrangement disposed above it is then advantageously greater than 5.8 μm and is in particular between 8.7 μm (150% of $G_{max}$) and 23.2 μm (400% of $G_{max}$). As a rule, the micromirrors have a uniform size, in particular edge length. In other preferred embodiments, the micromirrors of the micromirror arrangement have one maximum pitch, but different edge lengths. If a smaller edge length is chosen for micromirrors with a greater angle, a smaller maximum pitch can be maintained. Preferably, micromirrors with an angle of inclination below a critical angle with a uniform size (or edge length) and micromirrors with an angle of inclination above the critical angle with reduced size (or edge length) are provided. In the example computed above with $G_{max}$=5.8 μm in a micromirror arrangement, in this way micromirrors up to a maximum inclination of approximately 49 degrees can be present, if their edge length is only 5 μm instead of 10 μm.

Even if the procedure was explained on the basis of micromirror arrangements, a maximum pitch of the relief structures can also be determined analogously for other embossed relief structures.

The ink coatings of the relief structures are formed by glazing inks in advantageous embodiments. Metallizations, for example of aluminum, silver or an alloy, such as copper and aluminum, are also possible, as are thin-film structures, in particular color-shifting thin-film structures, color-stable, color-filtering thin-film structures (different colors in remission and transmission) or silicon-aluminum thin films. The ink coatings can also be formed by glazing inks backed with a metallic mirror coating, for example of aluminum. The ink coatings can represent a glazing image of several glazing inks, which is backed with a mirror coating, for example of aluminum. Luminescent inks, in particular fluorescent inks with a metallic mirror coating, are also conceivable as ink coatings. Finally, nanoparticle inks are also conceivable as ink coatings, such as gold-blue particles, various effect pigments, color-shifting pigments or supersilver.

An ink coating preferably follows the relief course of its relief structure. One surface (or both surfaces) of the ink coating follow the relief structure. The second surface of the ink coating (s) preferably also follows the relief structure. Alternatively, the second surface can be configured to be planar. In a further alternative—which is more difficult to manufacture—, the second surface of the ink coating comprises a chromophore chromatic structure, such as a subwavelength, nano or binary structure. The ink coatings are preferably applied directly to the relief structures, in particular the micromirror arrangements.

Different ink coatings can also be present in certain regions next to one another or one above the other. The ink coatings are preferably applied directly to the embossed structures, in particular the micromirror arrangements, and follow the relief course of the embossed structures. In the case of ink coatings of multi-layered configuration, for example a glazing ink with background metallization, it is, however, also possible that only some of the several layers, for example the background metallization, are applied directly to the embossed structures. The remaining part of the layers, for example the glazing ink, can then be arranged above the relief structures, for example between the coated relief structure region and the adjacent relief structure region disposed at a higher level. The second surface of a reflective partial layer of the ink coating(s) preferably also follows the relief structure. The second surface of a glazing ink partial layer of the ink coating(s) can also follow the relief structure, be configured to be planar or follow the other relief structure. The remaining part of the layers can also be combined with further layers, for example. For example, the embossing lacquer for the adjacent relief structure region disposed at a higher level can be dyed and thus represent a continuous ink partial coating for the relief structure region disposed at a lower level. The lower surface of the (first) dyed embossing lacquer preferably follows the lower relief structure and the upper surface of the dyed embossing lacquer forms the upper (first) relief structure.

The color impressions of the first and second ink coatings are different; they differ in their color tone. Both ink coatings preferably produce a chromatic color tone. Alternatively, one of the two ink coatings can produce an achromatic color tone, preferably silvery, for the viewer, and the other a chromatic color tone.

Outside the feature region, in particular in an overlap region of the two relief structures or outside the overlap region, other ink coatings, in particular with a third and/or a fourth color impression, can be employed. In further feature regions or outside the overlap region, other color combinations, in particular with a third (for example with the first or second) color impression or with a third and fourth color impression, can be present. Likewise, one of the (first, second, third or fourth) ink coatings outside the feature region or outside the overlap region can have a different chromatic color tone.

In addition to the ink coating of the relief structure disposed at a higher level, the ink coating of the relief structure disposed at a lower level can only be present in certain regions. Ink coatings present in certain regions can either be applied in certain regions and/or selectively removed again after full-area application. Some advantageous methods are described below with which the above-mentioned ink coatings can be provided only in certain regions. It is known to the person skilled in the art that not every method is suitable for all types of ink coatings. In particular, if several different ink coatings are used in a security element, several different methods can also be applied for the structuring.

Structured ink coatings with metallic inks, thin-film inks, structural inks or nanoparticles can be produced, for example, by using a washing ink. For this purpose, washing ink is printed for the respective embossing structure in insetter printing, then metalized over the full area and afterwards washed. In order to avoid a possibly present tolerance when printing the washing ink, the relief structure can be further adjusted. The relief structure can comprise in certain regions a fine structure that reduces (and/or increases) adhesion, which in particular has a hydrophobic (or hydrophilic) effect. The adhesion-reducing fine structure in one region thus in particular prevents the washing dye from adhering in the region. A first region with an adhesion-reducing fine structure can optionally adjoin a second region with an adhesion-increasing fine structure. Employing an optionally dyed etching resist is particularly advantageous in combination with glazing inks. For this purpose, the embossed structure can first be completely coated, then the etching resist is printed, wherein desired regions remain unprinted and finally the coating is etched. By applying a laser, in particular metallic inks, metallic mirror coatings and laser-sensitive, glazing inks can be removed with high resolution in certain regions. A light-absorbing fine structure, such as, for example, moth-eye structures or quasi-random structures, can be provided in certain regions in the relief structure. This increases the absorption of light so that lasers no longer have to be employed. Normal light sources such as UV lamps or LEDs can also be employed for removal. Metallic flakes, nanoparticle ink or supersilver (usually nanoscale aluminum particles) can be printed directly in register. Instead of the above-mentioned etching resist, an optionally dyed photo resist can first be applied over the full area and then exposed in certain regions. Depending on the resist employed, the exposed or unexposed regions then dissolve in the etching bath, so that the metal disposed underneath dissolves while the metallic areas covered by the photo resist remain protected from the etching.

Ink coatings can also be produced by a metal transfer process. Regions that are to be demetalized are high embossed with the aid of an embossing tool. The foil pretreated in this way is then completely metalized and the metal on the high-embossed places is selectively peeled off again with another foil so that only metal remains in the depressions. An ink transfer can also be produced in a similar manner. Regions that are later to appear colored are high embossed in relation to the remaining regions. A colorant, for example flakes, nanoparticle ink, supersilver or a glazing ink, is applied to a roller and selectively transferred to the high-embossed regions of the foil. Conversely, in an ink filling method, a desired ink coating is produced in that regions that are later to appear colored are deep embossed in relation to the remaining areas. A colorant, for example flakes, nanoparticle ink, supersilver or a glazing ink, is printed over the full area and then peeled off with a hard-adjusted chambered doctor blade or wiped off with a cloth, so that ink only remains in the depressions.

The security element described can additionally be equipped with colorless or colored negative markings. For this purpose, it can be provided in particular that the overlapping region additionally includes partial regions with a negative marking, in which the ink coating of the relief structure disposed at a higher level and at least partially also the ink coating of the relief structure disposed at a lower level is recessed.

The ink coating of the relief structure disposed at a lower level in the negative marking partial regions can be completely recessed, so that the negative marking does not produce any of the color impressions of the two ink coatings. The negative marking appears in particular colorless and can be recognized particularly well in transmitted light.

In another configuration, the ink coating of the relief structure disposed at a lower level is configured to be multilayered, wherein at least one of the multiple layers is recessed in the negative marking partial regions, so that a colored negative marking is created. The ink coating of the relief structure disposed at a lower level advantageously includes an opaque partial layer, in particular a metallization, and a glazing ink layer, wherein the opaque partial layer but not the glazing ink layer is recessed in the negative marking partial regions, so that a negative marking with the color effect of the glazing ink layer is created.

The line widths of the recesses of a negative marking disposed one above the other are advantageously above 100 μm, preferably above 150 μm, particularly preferably above 300 μm, in order to ensure that the negative marking can be easily recognized.

In a negative marking, the recesses in the ink coating of the relief structure disposed at a lower level are advantageously formed with a slightly larger area than the recesses in the ink coating of the relief structure disposed at a higher level in order to compensate for register fluctuations between the two relief structures.

In an advantageous embodiment, the relief structures are arranged on opposite sides of a transparent carrier foil. Alternatively, relief structures are arranged one above the other on the same side of a carrier foil. The relief structures can be arranged directly one above the other, or be separated from one another by an adhesive layer, for example a laminating adhesive layer or a laminating foil. The laminating foil can also form the areal carrier of the security element. After the security element has been applied to a target data carrier, the carrier of the target data carrier can also represent the areal carrier of the security element.

The invention further includes a data carrier with a security element of the type described. The data carrier can be in particular a value document, such as a banknote, in particular a paper banknote, a polymer banknote or a foil composite banknote, a share, a bond, a deed, a voucher, a check, a high-quality admission ticket, but also an identification card, such as a credit card, a bank card, a cash card, an authorization card, a personal identity card or a passport personalization page.

Finally, the invention also includes a method for manufacturing a security element of the type described above, in which

- a carrier is made available, the areal expansion of which defines an x-y plane and a z axis standing perpendicularly thereon,
- the carrier is supplied with a multicolored, reflective areal region, which is formed with at least two relief structures, which are arranged in the z direction at different height levels with reference to the areal carrier, the relief structures are each supplied with an ink coating which, when viewed from the +z direction, produce a different color impression of the two relief structures, and the two relief structures are configured to overlap and the ink coating of the relief structure disposed at a higher level in the overlapping region in a feature region is configured as a regular or irregular grid with grid elements and grid spaces, wherein the dimensions of the grid elements and/or grid spaces are below 140 μm at least in one direction, so that, in the feature region, the ink coating of the relief structure disposed at a lower level appears through the grid spaces of the ink coating of the relief structure disposed at a higher level.

For the sake of completeness, it should be noted that the resulting color impression is determined by the ink coating, so that the present relief structures could also be referred to as achromatic relief structures. No relief structures in the present sense are chromatic structures such as diffraction gratings, sub-wavelength gratings or blazed gratings which filter, diffract and/or reflect white light in a wavelength-selective manner and produce their own color impression. In embodiments, the carrier can be part of the security element. In other embodiments, the security element is removed from the carrier, for example when the security element is transferred from the carrier to a target substrate.

BRIEF DESCRIPTION OF THE DRAWINGS

Further embodiment examples as well as advantages of the invention will be explained hereinafter with reference to the figures, in whose representation a rendition that is true to scale and to proportion has been dispensed with in order to increase the clearness.

There are shown.

DETAILED DESCRIPTION OF VARIOUS EMBODIMENTS

Figure 1:
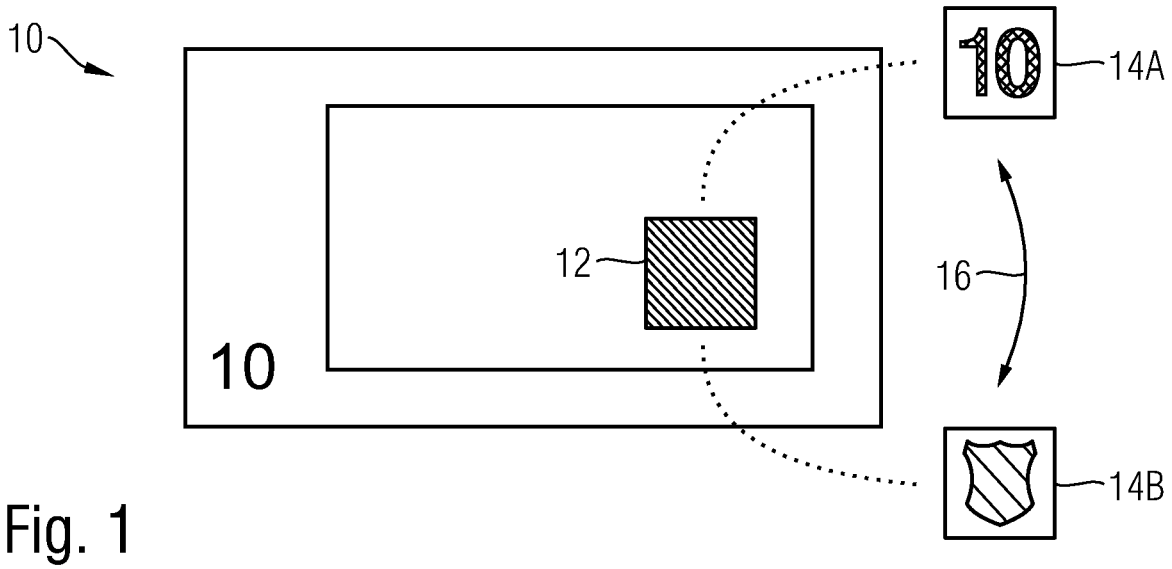
FIG. 1 a schematic representation of a banknote with a security element according to the invention, FIG. 2 schematically a detail of the security element of FIG. 1 in cross section, FIG. 3, including FIGS. 3(*a*) to 3(*d*), some concrete advantageous embodiments of the grid of the ink coating of the micromirror arrangement disposed at a higher level in plan view, FIGS. 4 to 7 some visually attractive effects that can be realized with security elements according to the invention, wherein the respective feature region of a security element is shown in two different tilted positions in (a) and (b), FIG. 8, including FIGS. 8(*a*) to 8(*d*), some advantageous foil structures of security elements according to the invention, FIG. 9 a security element according to the invention with an additional region with color-to-effect registration, and FIG. 10 a security element according to the invention with an additional region with a negative marking.

The invention will now be explained on the basis of the example of security elements for banknotes. FIG. 1 shows a schematic representation of a banknote 10 with an optically variable security element 12 according to the invention in the form of an adhesively bonded transfer element. It goes without saying, however, that the invention is not limited to transfer elements and banknotes but can be used for all types of security elements, for example for labels on goods and packaging or for securing documents, identity cards, passports, credit cards, health cards and the like. In the case of banknotes and similar documents, in addition to transfer elements (such as a patch with or without its own carrier layer), security threads or security strips, for example, are also conceivable.

The security element 12 shown in FIG. 1 is itself configured to be very flat, but nevertheless gives the viewer a three-dimensional impression and also shows a binary change in color and effect when the banknote 10 is tilted. From a first viewing direction, the security element 12 shows a first motif 14-A that appears to bulge out of the plane of the banknote 10, for example a curved representation of the value number "10" which appears with a first color, for example red. From a second viewing direction, the security element 12 shows a second motif 14-B that appears to bulge out of the plane of the banknote 10, for example a curved representation of a coat of arms that appears with a second color, for example blue.

When tilting 16 the banknote 10 or a corresponding change in the viewing direction, the appearance of the security element 12 suddenly switches from the first to the second appearance or when tilting back from the second to the first appearance. The change of the motif (value number or coat of arms) and the color (red or blue) takes place simultaneously and without an intermediate or transitional stage in which both motifs or colors would be visible at the same time or a motif would be visible in the color of the other motif. The appearance therefore switches seamlessly between two appearances 14-A, 14-B and is therefore referred to as a binary change in color and effect.

The particular structure of optically variable security elements according to the invention will now be explained in more detail with reference to FIG. 2, which shows a detail of the security element 12 schematically in cross section. The security element 12 includes an areal carrier 18, the areal expansion of which defines an x-y plane and a z axis standing perpendicularly thereon.

A multicolored reflective areal region 20 is arranged on the carrier 18 and includes two embossed structure regions which are arranged in the z direction at two specific, different height levels with reference to the areal carrier 18. In the embodiment example, the embossed structure regions each represent micromirror embossings or micromirror arrangements 24, 34 which are each formed from a multiplicity of micromirrors inclined with respect to the x-y plane. The local angles of inclination of the micromirrors are chosen exactly so that the relief structure of the micromirror arrangements 24, 34 produces a desired optical appearance after the ink coating. The different height levels are given by the different heights H1, H2 of the base areas of the micromirror arrangements 24, 34 above the carrier 18.

Concretely, the angles of inclination of the micromirrors in the embodiment example are chosen so that the micromirror arrangement 24 produces the curved representation of the value number "10" in a viewing angle range of +5° to +20° (viewing position 40-A) with reference to the surface normal 42, and the micromirror arrangement 34 produces the curved representation of the coat of arms in a viewing angle range of −5° to −20° (viewing position 40-B).

In order to produce a visual contrast with the desired color effect, the micromirror arrangements 24, 34 are each supplied with an ink coating 26, 36, which when viewed from above from a viewing position 40-A or 40-B of the viewer 40 produce the different color impression of the micromirror arrangements. In the embodiment example, the micromirror arrangement 24 is coated with a red glazing ink 26, while the micromirror arrangement 34 is coated with a blue glazing ink 36.

The micromirror arrangements 24, 34 are each embossed into a transparent embossing lacquer layer 22, 32 and, after the application and optionally structuring of the respective ink coating 26, 36, are leveled with a transparent top-coat lacquer layer 28 or 38, respectively. The top-coat lacquer layers have substantially the same refractive index as the embossing lacquer layers 22, 32, so that the micromirrors in regions without an ink coating do not appear visually due to the lack of refractive index difference between the embossing lacquer layer and the top-coat lacquer layer.

The security element 12 is configured for viewing from above (in reflection), so that the micromirror arrangement 24 further away from the viewer 40 is referred to as the micromirror arrangement disposed at a lower level and the micromirror arrangement 34 lying closer to the viewer 40 is referred to as the micromirror arrangement disposed at a higher level.

In the embodiment example, the two micromirror arrangements 24, 34 are arranged one above the other in the entire areal region 20 of the security element 12. While the red ink coating 26 of the micromirror arrangement disposed at a lower level 24 is continuous, the blue ink coating 36 of the micromirror arrangement disposed at a higher level 34 is formed in a feature region of the security element in the form of a regular grid 50 of grid elements 52 and grid spaces 54. Concretely, the grid elements 52 and grid spaces 54 in the embodiment example form a checkerboard pattern in which each field, that is each grid element 52 and each grid space 54, has a dimension of 100 μm×100 μm. Since the micromirrors are usually significantly smaller, for example have an edge length of only 10 μm, the grid 50 of the ink coating 36, unlike in the simplified schematic representation of FIG. 2, is generally not congruent with the grid of the micromirrors of the micromirror arrangement 34.

From the viewing direction 40-A, the micromirrors of the micromirror arrangement 34 in the grid spaces 54 due to the lack of refractive index difference of the lacquer layers 32, 38 do not develop an optical effect, so that the viewer 40 looks there at the red-coated micromirrors of the micromirror arrangement 24, which are substantially at a glancing angle for the viewing direction 40-A. In the region of the grid elements 52, the micromirrors of the micromirror arrangement 34 are fundamentally perceptible, but their orientation is far removed from the glancing angle and they therefore appear inconspicuous from the viewing direction 40-A and practically do not contribute to the image impression. Overall, the viewer from the viewing direction 40-A thus sees substantially the red appearance 14-A of the curved value number "10" produced by the micromirror arrangement 24.

From the viewing direction 40-B, the viewer looks at the blue-coated micromirrors of the micromirror arrangement 34 in the region of the grid elements 52. In the region of the grid spaces 54, the viewer can fundamentally perceive the micromirrors of the micromirror arrangement disposed at a lower level 24, but from the viewing direction 40-B their orientation is far removed from the glancing angle. The micromirror arrangement 24 therefore appears inconspicuous and practically does not contribute to the image impression. Overall, from the viewing direction 40-B the viewer thus substantially sees the blue appearance 14-B of the curved coat of arms produced by the micromirror arrangement 34.

Since the grid elements 52 and the grid spaces 54 each have the same dimensions, the area coverage of the grid 50 in the embodiment example is 50%, which also results in the same brightnesses of the two appearances 14-A, 14-B with the chosen ink coatings 26, 36. If inks or if ink coatings of different brightness are chosen for the two micromirror arrangements, an area coverage of the grid 50 deviating from 50% can also be chosen in order to compensate for the different color brightnesses and to produce approximately equally bright appearances 14-A, 14-B. Alternatively, different bright appearances 14-A, 14-B can also be produced in a targeted manner through the area coverage.

Figure 2:
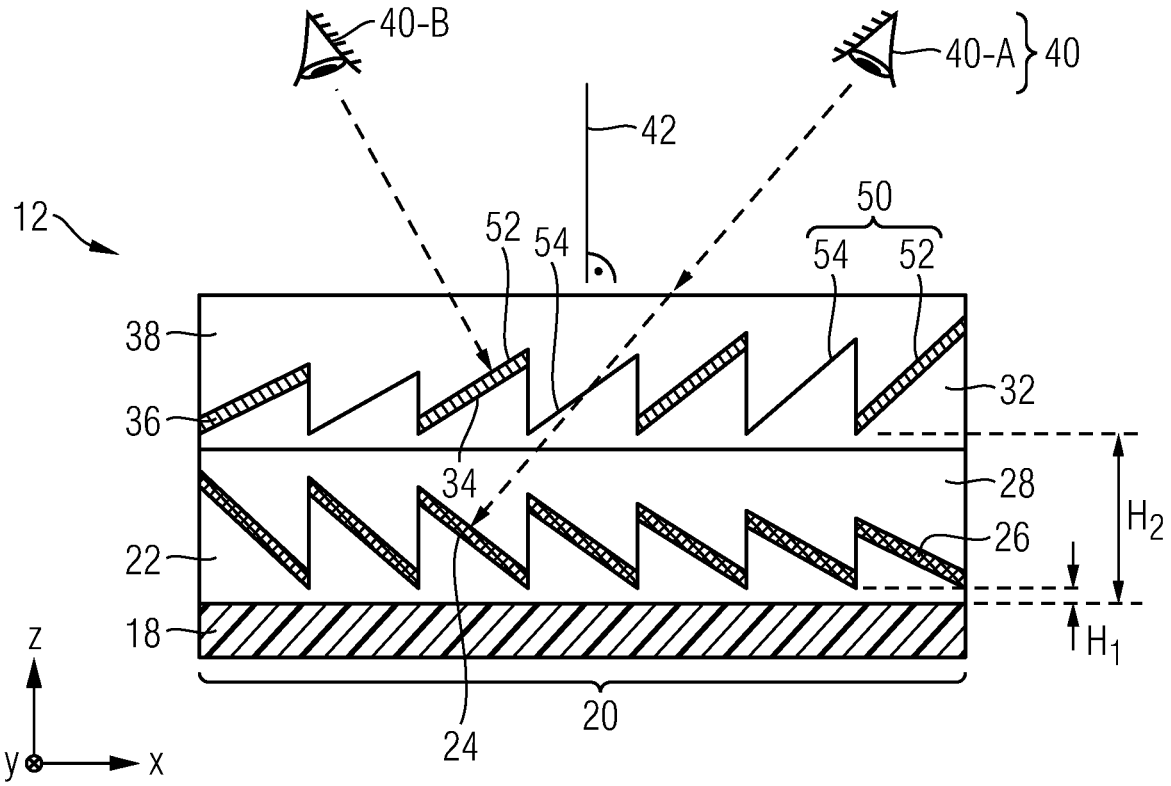
Figure 3:
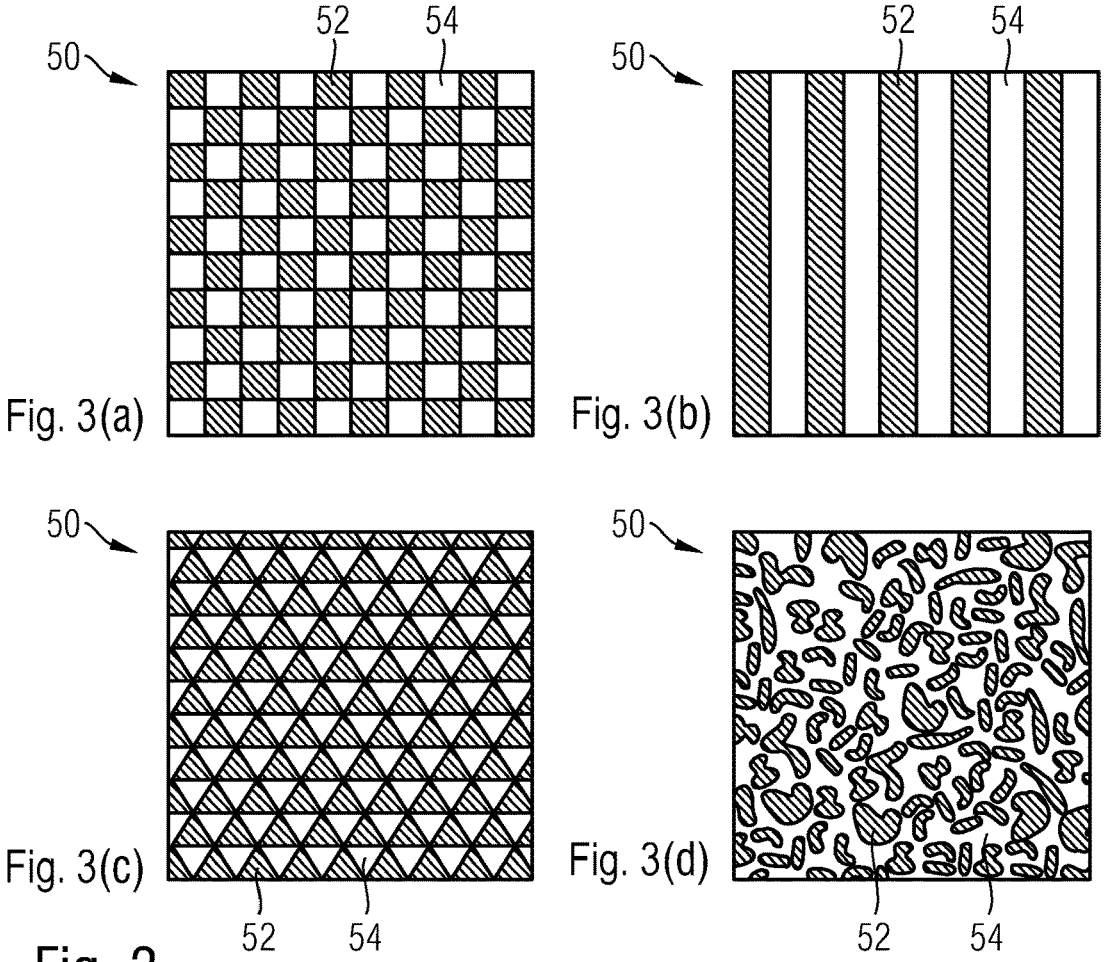

FIG. 3 shows a top view of some concrete advantageous configurations of the grid of the ink coating 36 of the micromirror arrangement disposed at a higher level 34. FIG. 3(*a*) shows a grid 50 as employed in FIG. 2, in which the grid elements 52 and the grid spaces 54 form a checkerboard pattern. The dimensions of the grid elements and grid spaces are advantageously between 20×20 $\mu m^2$ and 140×140 $\mu m^2$; the area coverage is 50%. If an area coverage that deviates from this is to be produced, some of the grid elements 52 can be omitted or some of the grid spaces 54 can be covered with grid elements. In this, but also in the configurations described below, the surface coverage of the grid with grid elements is preferably between 30% and 70%, in particular between 40% and 60%.

FIG. 3 (*b*) shows a grid 50 with alternately arranged strip-shaped grid elements 52 and grid spaces 54. The width of the grid elements and grid spaces is advantageously between 20 μm and 140 μm, the length is arbitrary and can be several millimeters or even a few centimeters. The area coverage can easily be set via the relative width of the grid elements and grid spaces.

The grid elements and grid spaces can also have other polygonal shapes or irregular shapes. By way of example, FIG. 3(*c*) shows an embodiment in which the grid elements 52 and grid spaces 54 of the grid 50 are formed by triangles. In the grid 50 of FIG. 3(*d*), the grid elements 52 and grid spaces 54 are formed by irregular shapes. The grid elements and/or grid spaces can also form a coherent structure, as shown for example in FIG. 3(*d*) for the grid spaces 54.

The FIGS. 4 to 7 illustrate some visually attractive effects that can be achieved with security elements according to the invention. The figures in (a) and (b) each show the feature region of a security element in two different tilt positions, for example tilted down or up or tilted to the left or right.

Figure 4:
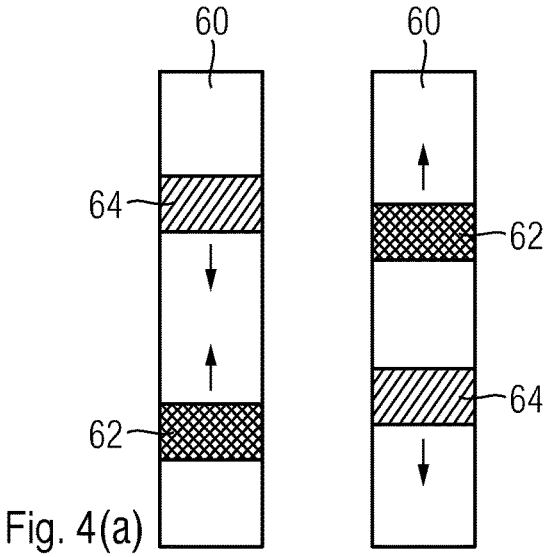

In the security element 60 of the embodiment example in FIG. 4, the angles of inclination of the micromirrors of the red-coated micromirror arrangement disposed at a lower level 24 are chosen such that they produce a red rolling bar effect in the feature region, i.e. a bright red bar 62 that, when the banknote is tilted, appears to run up or down along the feature region of the security element 60 depending on the tilting direction, as indicated by the arrows in FIGS. 4(*a*) and (*b*). The angles of inclination of the micromirrors of the blue-coated micromirror arrangement disposed at a higher level 34 are chosen in such a manner that they simultaneously produce an opposing blue rolling bar effect in the feature region, i.e. a bright blue bar 64 that, when the security element is tilted, runs respectively contrary to the red bar of the micromirror arrangements disposed at a lower level 24. Due to the gridding of the blue ink coating 36 disposed at a higher level there are always, even in the overlapping position in which both bars 62, 64 seem to be in the same place, both the blue bar 64 of the micromirror arrangement disposed at a higher level 34 and the red bar 62 of the micromirror arrangement disposed at a lower level 24 are visible, so that the two bars 62, 64 seem to run through each other for the viewer. The height difference of the two micromirror arrangements 24, 34 is in the range of a few micrometers or a few tens of micrometers and is therefore imperceptible to the viewer. In almost all parts of the feature region, also in this example, there appears for the viewer, depending on the viewing angle, either the ink coating of the relief structure disposed at a higher level or the ink coating of the relief structure disposed at a lower level. In the part of the feature region in which the bars are superimposed, both ink coatings are visible at the same time. The fact that a mixed color tone arises in this part is less noticeable due to the movement of the bars.

In variants not shown, the security element 60 can show other optical effects adjoining or adjacent to the feature region shown, for example a non-moving—possibly curved—blue edge strip adjacent to the right, a non-moving—possibly curved—red edge strip adjacent to the left and/or above and underneath (viewed from above) a non-moving—possibly curved—purple edge strip.

Figure 5:
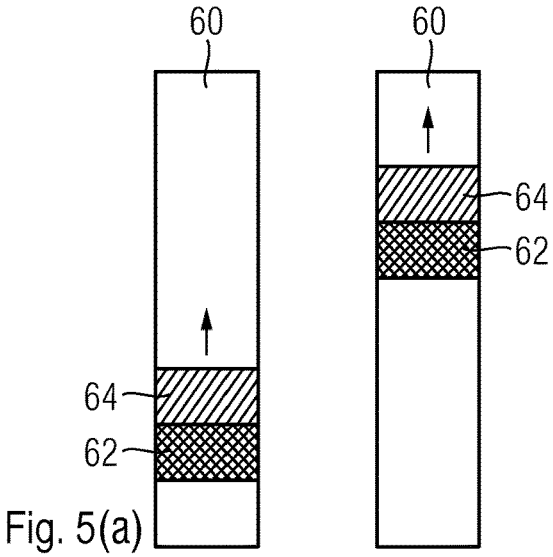

FIG. 5 shows a modification of the configuration of FIG. 4, in which the micromirror arrangements 24, 34 again produce a red or blue rolling bar effect. In contrast to the configuration of FIG. 4, the two, colored bars 62, 64 in the security element of FIG. 5 are offset from one another and move together in the same direction when tilted, as indicated by the arrows in the figure. Alternatively, the bars 62, 64 can also move at different speeds and amplitudes in the same direction, so that during the tilting movement one bar appears to be overtaken by the other bar. Due to the gridding of the ink coating, both bars are always visible, even in the overlapping position in which both bars appear to be in the same place.

The security element 70 of FIG. 6 shows an attractive combination of a color change with 3-D and movement effects. The angles of inclination of the micromirrors of the micromirror arrangements 24 are chosen so that they produce two nested rings 72 and 74 with a three-dimensional appearance for the viewer, wherein the red rings 72 of the micromirror arrangement disposed at a lower level 24 are visible in a viewing angle range of +5° to +20° (FIG. 6(*a*), corresponding to viewing position 40-A in FIG. 2), and the blue rings 74 of the micromirror arrangement disposed at a higher level 34 are visible in a viewing angle range of −5° to −20° (FIG. 6(*b*), corresponding to viewing position 40-B in FIG. 2). When the security element 70 is tilted, in addition to the three-dimensional appearance of the rings 72, 74, there is also a binary color change from red to blue and back.

FIG. 7 shows a modification of the configuration of FIG. 6, in which the micromirror arrangements 24, 34 again produce rings that appear three-dimensional, but here in such a manner that, in a viewing angle range of +5° to +20°, the inner red ring 72 of the micromirror arrangement disposed at a lower level 24 and at the same time the outer blue ring 74-B of the micromirror arrangement disposed at a higher level 34 are visible (FIG. 7(*a*)). Conversely, in a viewing angle range of −5° to −20°, the outer red ring 72-B of the micromirror arrangement disposed at a lower level 24 and the inner blue ring 74-A of the micromirror arrangement disposed at a higher level 34 are visible (FIG. 7 (*b*)). The security element 70 of FIG. 7 therefore shows red and blue rings respectively lying one inside the other with a three-dimensional appearance, wherein the outer and inner rings each change colors binarily when the security element is tilted.

Some advantageous foil structures of security elements according to the invention are shown in FIG. 8. In the security element 80 of FIG. 8(*a*), a transparent embossing lacquer layer 22, 32 with the desired micromirror embossings or micromirror arrangements 24, 34, the ink coating 26, 36 and the transparent top-coat lacquer layer 28, 38 is arranged on the two opposite sides of an areal carrier 18, for example a transparent PET carrier foil 18. The security element 80 is constructed for viewing from the side of the ink coating 36, so that the ink coating 36 of the micromirror arrangement disposed at a higher level 34 is configured as a grid with grid elements 52 and grid spaces 54 through which the viewer looks at the micromirror arrangement disposed at a lower level 24 with the ink coating 26.

The security element 82 of FIG. 8(*b*) has the layer structure already described for FIG. 2. Both micromirror embossings or micromirror arrangements 24, 34 are arranged on the same side of the carrier foil 18, which does not have to be transparent in this embodiment. On the carrier foil there are arranged in this order the first embossing lacquer layer 22 with the first micromirror embossing or micromirror arrangement disposed at a lower level 24, the first ink coating 26, the first transparent top-coat layer 28, the second, transparent embossing lacquer layer 32 with the second, micromirror embossing or micromirror arrangement disposed at a higher level 34, the second ink coating 36 and the second transparent top-coat layer 38. The security element 82 is constructed for viewing from the side of the ink coating 36, so that the ink coating 36 of the micromirror arrangement disposed at a higher level 34 is configured as a grid with grid elements 52 and grid spaces 54 through which the viewer looks at the micromirror arrangement disposed at a lower level 24 with the ink coating 26.

Further variants of FIG. 8*b* are not shown separately in the figures. A transparent foil can also be arranged above the further layers 22, 26, 28 and 32, 36, 38. The transparent foil can be the carrier foil 18 of the security element, a further carrier foil or serve as a protective foil. The order of the further layers 22, 26, 28 and 32, 36, 38 can be unchanged. Alternatively, the first embossing lacquer layer 22 can be disposed above the first top-coat layer 28 and/or the second embossing lacquer layer 32 can be disposed above the second top-coat layer 38. Below the transparent foil 18 arranged above, for example, the further layers follow in the order 32, 36, 38, 22, 26, 28.

Independently of the position of the carrier foil 18, the following variants are possible proceeding from FIG. 8*b*. The ink coating 26 and the top-coat layer 28 and/or the ink coating 36 and the top-coat layer 38 can be formed by an ink coating 26 or 36 with—in particular planar—upper surface. The ink coating 26 and/or 36 comprises a reflective partial layer (such as metallization), which follows its relief structure with both surfaces, as well as a partial layer with glazing ink, whose lower surface follows the relief structure, while the upper surface of the glazing ink partial layer does not follow the relief structure, preferably is configured to be planar. In a further variant, an upper, color-glazing partial layer of the lower ink coating 26 in FIG. 8*b* forms the lower top-coat layer 28 and at the same time the upper embossing lacquer layer 32. The ink coating 26 preferably in turn comprises a reflective partial layer (such as metallization), which follows its relief structure with both surfaces. A glazingly dyed partial layer, preferably an embossing lacquer layer, of the ink coating 26 follows the lower relief structure of the micromirror arrangement 24 with its lower surface and the upper relief structure of the micromirror arrangement 34 with its upper surface. In an even further variant, the lower ink coating comprises at least (or precisely) three partial layers, a reflective partial layer, a compensating partial layer and a partial layer with a glazing ink, preferably dyed embossing lacquer. The reflective partial layer follows the second, lower relief structure of the micromirror arrangement 24 with one (or both) surface(s) and the color-glazing partial layer follows the first, upper relief structure of the micromirror arrangement 34 with its upper side.

In other configurations, two foils 18-A, 18-B can also be used in the manufacture of the security element, each of which foils is supplied separately with one of the micromirror structures 22-28 or 32-38 and then suitably laminated together.

In the security element 84 of FIG. 8(*c*), the two carrier foils 18-A, 18-B are laminated together in such a manner that the micromirror structures 22-28 and 32-38 are disposed on the inside. The lamination 86 can comprise a laminating foil or it can be formed only by a laminating adhesive. In this configuration, one or both of the carrier foils 18-A, 18-B can be peeled off after the lamination in order to configure the security element 84 to be as thin as possible. In particular when employing a laminating foil, even both carrier foils 18-A, 18-B can be peeled off, since the stability of the security element 84 is ensured by the laminating foil, which then acts as an areal carrier of the security element. The security element 84 is also constructed for viewing from the side of the ink coating 36, so that the ink coating 36 of the micromirror arrangement disposed at a higher level 34 is configured as a grid with grid elements 52 and grid spaces 54 through which the viewer looks at the micromirror arrangement disposed at a lower level 24 with the ink coating 26.

In the security element 88 of FIG. 8(*d*), the carrier foils 18-A, 18-B are laminated together in such a manner that one micromirror structure 22-28 is disposed on the inside and the other micromirror structure 32-38 is disposed on the outside. The lamination 86 can comprise a laminating foil or be formed only by a laminating adhesive. The carrier foil 18-A located on the outside can be peeled off after lamination in order to configure the security element 88 to be as thin as possible. Here, too, the ink coating 36 of the micromirror arrangement 34 disposed on a higher level is configured as a grid with grid elements 52 and grid spaces 54 in order to enable the viewer to look at the micromirror arrangement 24 disposed on a lower level with the ink coating 26.

A further variant, not shown in the figure, finally consists in laminating the carrier foils together in such a manner that both micromirror structures 22-28 or 32-38, 52, 54 are disposed on the outside.

As already explained in more detail above, the ink coatings 26, 36 can be formed not only by glazing inks, but also, for example, by metalizations, by thin-film structures, by glazing inks backed with a metallization, by luminescent inks with metallic mirroring, by structural inks or by nanoparticle inks.

As also already stated, the carrier foil 18 is an optional element. It can therefore be omitted in each of the variants shown, mentioned or following. For example, the carrier foils 18 in FIG. 8(*b*), the carrier foil(s) 18-AB in FIG. 8(*c*) or the carrier foil 18-A in FIG. 8(*d*) can be removed before (or after) an application of the security element to a target substrate. A release layer, not shown, which is disposed between the carrier foil and the further layers, is provided in such configurations.

In addition to the described feature region with a gridded ink coating, the security elements according to the invention can also have partial regions with other effects, for example a color-to-effect registration or negative markings.

In the security element 90 of FIG. 9 shown by way of example for this purpose, only the micromirror structures 22-28 and 32-38 are shown without carrier foils or further layers of the layer structure for the sake of simplicity. The security element 90 includes a feature region 92 in which the micromirror arrangements 24, 34 and ink coatings 26, 36 are configured as described above and in particular the ink coating 36 is configured in the form of a grid with small grid elements 52 and grid spaces 54.

In addition to the feature region 92, the security element 90 has an marking region 94 with a color-to-effect registration. A motif that appears to bulge out of the plane of the security element 90 or a movement effect with a first color, for example blue, is visible there in a first partial region 94-A. A movement effect with a second color, for example a red rolling bar effect, is visible within the blue motif in a second partial region 94-B. As a special feature the areas of different colors (red or blue) and different effects (bulging motif or running bar) are disposed in exact mutual register.

For this purpose, the ink coating 36 of the micromirror arrangement disposed at a higher level 34 has a large-area recess 96 with a dimension of more than 140 μm, in particular of more than 300 μm, in the partial region 94-B. In the region of the recess 96 the micromirrors develop no optical effect due to the lack of refractive index difference between the lacquer layers 32, 38, so that the viewer looks through these lacquer layers at the micromirror arrangement disposed at a lower level 24 with its red ink coating 26. Outside the recess 96, the visual impression of the marking region 94, on the other hand, is determined by the micromirror arrangement disposed at a higher level 34 with its blue ink coating 36.

A viewer therefore perceives the blue motif produced by the micromirror arrangement 34 outside the recess 96, that is in the partial region 94-A, while inside the recess 96, in the partial region 94-B, the red rolling bar effect of the micromirror arrangement 24 appears. The height difference of the two micromirror arrangements 24, 34 is in the range of a few micrometers or a few tens of micrometers and is therefore imperceptible to the viewer. The two different colored motifs and the different effects of the partial regions 94-A, 94-B therefore appear to be arranged next to one another in exact register for the viewer.

In the embodiment example of FIG. 10, the security element 100 has, in addition to a feature region 92 of the type described above, also partial regions 102 in which the ink coatings 26, 36 of both micromirror arrangements 24, 34 are recessed (recesses 96 and 104) so that the security element 100 does not show any of the color impressions of the two ink coatings in these regions.

The shape of the partial regions 102 forms a negative marking, in particular a negative writing, which can be recognized particularly well in transmitted light with an at least translucent configuration of the further layers of the security element 100. In the partial regions 102, the recesses 104 of the ink coating 26 of the micromirror arrangement disposed at a lower level 24 are formed with a slightly larger area than the associated recesses 96 in the ink coating 36 in order to absorb register fluctuations between the two embossed structures of the micromirror arrangements 24, 34. The line widths of the recesses 96, 104 disposed one above the other are greater than 100 μm, in particular greater than 300 μm, in order to ensure that the negative markings can be easily recognized.

Colored negative markings can also be provided. For this purpose, for example, the ink coating 26 of the micromirror arrangement disposed at a lower level 24 can be configured to have several layers, for example by means of a glazing ink backed with a metallization. In the negative identification partial regions, in addition to the ink coating 36 of the micromirror arrangement disposed at a higher level 34, the metallization of the ink coating 26 of the micromirror arrangement disposed at a lower level 24 is also recessed, but the glazing ink is retained. The negative marking then appears colored and translucent due to the lack of metallization there.

The invention claimed is:

1. An optically variable security element, the surface expansion of which defines a z direction standing perpendicularly thereon, with a multicolored, reflective areal region, wherein the multicolored, reflective areal region includes two relief structures separated by a top-coat layer or a transparent embossing lacquer layer, the two relief structures arranged at different height levels in the z direction, the relief structures are each supplied with an ink coating that produce a different color impression, the two relief structures overlap in a feature region, the ink coating of the relief structure disposed at a higher level is configured in the feature region as a regular or irregular grid with grid elements and grid spaces, and the dimensions of the grid elements and/or grid spaces are below 140 μm at least in one direction, so that, in the feature region, for a viewer from at least one viewing angle, the ink coating of the relief structure disposed at a lower level appears through the grid spaces of the ink coating of the relief structure disposed at a higher level, wherein the relief structures and the ink coating form non-diffractive micromirror arrangements with directional micromirrors.

2. The security element according to claim 1, wherein the grid elements and grid spaces of the grid have the same shape and the same size.

3. The security element according to claim 1, wherein the area coverage of the grid by the grid elements is between 30% and 70%.

4. The security element according to claim 3, wherein the area coverage of the grid and the brightness of the ink coatings are matched to one another in order to produce, when viewed, substantially the same brightness of the ink coating of the relief structure disposed at a higher level and the ink coating of the relief structure disposed at a lower level that appears through the grid spaces.

5. The security element according to claim 1, wherein the dimensions of the grid elements and/or the grid spaces in one or both lateral directions are between 20 μm and 140 μm.

6. The security element according to claim 1, wherein at least in a part of the feature region either the ink coating of the relief structure disposed at a higher level or the ink coating of the relief structure disposed at a lower level appears for the viewer, depending on the viewing angle, wherein in a different part of the feature region both ink coatings are visible at the same time for the viewer from at least one viewing angle.

7. The security element according to claim 1, wherein the two relief structures, depending on the viewing angle, show a color change for an unchanged motif; or show a color change together with a motif change, wherein a motif change of the two relief structures includes differences with regard to shape, movement and/or three-dimensionality of a respective motif.

8. The security element according to claim 1, wherein the relief structure disposed at a higher level produces a first motif with a first color impression, which is visible from a first viewing angle range, and the relief structure disposed at a lower level produces a second motif with a second, different color impression, which is visible from a second viewing angle range, wherein the first and second viewing angle ranges do not overlap.

9. The security element according to claim 1, wherein the relief structure disposed at a higher level produces a first movement motif with a first color impression and the relief structure disposed at a lower level produces a second movement motif with a second, different color impression, wherein, when the security element is tilted, the first and the second movement motif move in a manner offset to one another or in a manner against one another and, in an overlap position in which both movement motifs are visible, cross each other and/or move consecutively through the same part of the feature region.

10. The security element according to claim 1, wherein the reflective areal region includes exactly two relief structures, each of which is arranged at a specific height level defined along the z direction.

11. The security element according to claim 1, wherein the relief structures are each characterized by a maximum pitch and a difference between adjacent height levels in the z direction is greater than the maximum pitch of the relief structure disposed at a lower level.

12. The security element according to claim 1, wherein the ink coatings are formed by glazing inks, by metallizations, thin-film structures, by glazing inks backed with a metallization, by luminescent inks with a metallic mirroring, by structural inks and/or by nanoparticle inks.

13. The security element according to claim 1, wherein in the feature region there is additionally provided at least one partial region with a negative marking, in which gaps are present in the ink coating of the relief structure disposed at a higher level and at least partially also the ink coating of the relief structure disposed at a lower level.

14. The security element according to claim 13, wherein the ink coating of the relief structure disposed at a lower level is completely absent in the at least one partial region, so that the negative marking does not produce any of the color impressions of the two ink coatings.

15. The security element according to claim 13, wherein the ink coating of the relief structure disposed at a lower level is configured to be multilayered, and at least one of the several layers is absent in the at least one partial region, so that a colored negative marking is created.

16. The security element according to claim 1, wherein each grid element corresponds to exactly one directional micromirror or several directional nano mirrors or micromirrors.

17. A data carrier with an optically variable security element according to claim 1.

18. A method for manufacturing an optically variable security element with a multicolored, reflective areal region, the method comprising:

providing a carrier, a surface expansion of which defines a z direction standing perpendicularly thereon, and supplying the carrier with a multicolored, reflective areal region which includes at least two relief structures separated by a top-coat layer or a transparent embossing lacquer layer, the two relief structures arranged at different height levels in the z direction, wherein the relief structures are each supplied with an ink coating which produce a different color impression, the two relief structures configured to overlap in a feature region, wherein the ink coating of the relief structure disposed at a higher level is configured in the feature region as a regular or irregular grid with grid elements and grid spaces, and wherein the dimensions of the grid elements and/or grid spaces at least in one direction are below 140 μm, so that, in the feature region, for a viewer from at least one viewing angle, the ink coating of the relief structure disposed at a lower level appears through the grid spaces of the ink coating of the relief structure disposed at a higher level, wherein the relief structures and the ink coating form non-diffractive micromirror arrangements with directional micromirrors.

19. The method according to claim 18, wherein the optically variable security element is separated from the carrier.

20. An optically variable security element, the surface expansion of which defines a z direction standing perpendicularly thereon, with a multicolored, reflective areal region, wherein the multicolored, reflective areal region includes two relief structures separated by a transparent layer, the two relief structures arranged at different height levels in the z direction, the relief structures are each supplied with an ink coating that produce a different color impression, the two relief structures overlap in a feature region, the ink coating of the relief structure disposed at a higher level is configured in the feature region as a regular or irregular grid with grid elements and grid spaces, and the dimensions of the grid elements and/or grid spaces are below 140 μm at least in one direction, so that, in the feature region, for a viewer from at least one viewing angle, the ink coating of the relief structure disposed at a lower level appears through the grid spaces of the ink coating of the relief structure disposed at a higher level, wherein the relief structures and the ink coating form non-diffractive micromirror arrangements with directional micromirrors.

* * * * *